US006276792B1

(12) United States Patent
Gundlach et al.

(10) Patent No.: US 6,276,792 B1
(45) Date of Patent: Aug. 21, 2001

(54) COLOR PRINTING APPARATUS AND PROCESSES THEREOF

(75) Inventors: Robert W. Gundlach, Victor; Kurt B. Gundlach; Luis A. Sanchez, both of Fairport; Maura A. Sweeney, Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/282,318

(22) Filed: Mar. 31, 1999

(51) Int. Cl.[7] ..... B41J 2/01
(52) U.S. Cl. ..... 347/101; 347/105
(58) Field of Search ..... 347/101, 103, 347/105, 7, 19, 96, 212

(56) References Cited

U.S. PATENT DOCUMENTS

| | | | | |
|---|---|---|---|---|
| 3,901,698 | * | 8/1975 | Fukushima et al. | 96/1 |
| 4,997,697 | | 3/1991 | Malhotra | 428/195 |
| 5,045,888 | * | 9/1991 | Imaeda | 355/282 |
| 5,101,216 | * | 3/1992 | Mey et al. | 346/1.1 |
| 5,321,467 | | 6/1994 | Tanaka et al. | 355/202 |
| 5,339,146 | * | 8/1994 | Aslam et al. | 355/285 |
| 5,506,671 | * | 4/1996 | Buts et al. | 355/326 |
| 5,612,777 | | 3/1997 | Malhotra | 399/226 |
| 5,729,785 | | 3/1998 | Sakaizawa et al. | 399/2 |
| 5,847,738 | | 12/1998 | Tutt et al. | 347/101 |

* cited by examiner

*Primary Examiner*—John S. Hilten
*Assistant Examiner*—Minh Chau

(57) ABSTRACT

A process including:

depositing a colorless toner onto a substrate;

depositing at least one ink image onto the colorless toner and substrate; and fixing the resulting ink image onto the substrate.

11 Claims, No Drawings

COLOR PRINTING APPARATUS AND PROCESSES THEREOF

REFERENCE TO COPENDING APPLICATIONS

Attention is directed to commonly owned and assigned copending Application No., U.S. Ser. No. 08/107,581, entitled "INK COMPOSITIONS AND IMAGING PROCESSES THEREOF," and copending Application No., U.S. Ser. No. 08/216,774, entitled "INK COMPOSITIONS AND IMAGING PROCESSES THEREOF."

The disclosure of the above mentioned copending applications are incorporated herein by reference in their entirety. The appropriate components and processes of these patent applications may be selected for, for example, inks and processes of the present invention in embodiments thereof.

BACKGROUND OF THE INVENTION

The present invention is generally directed to a printing apparatus, treated receiver sheets, and imaging processes thereof. More specifically, the present invention is directed to a color printing apparatus, receiver sheets or substrates that are pretreated with colorless toner and optionally other print quality performance enhancing additives, and imaging processes thereof which provide improved hybrid electrostatographic-ink jet printing processes and improved image properties. The apparatus and processes of the present invention possess a number of advantages such as superior hybrid toner-ink images with excellent resolution, reduced image defects, and print stability properties, such as water and light fastness properties.

PRIOR ART

In U.S. Pat. No. 5,847,738, issued Dec. 8, 1998, to Tutt, et al., there is disclosed a process of forming an overcoat on a printed image to provide improved stability comprising: a) applying an image layer on a substrate using a liquid ink to form an imaged element; b) either charging the imaged element to a given polarity or applying a voltage across the surface of the element which is attracted to a conductive surface behind the element; c) applying colorless, charged particles to the element which causes them to be electrostatically attracted to the surface of the image layer; and d) heat-fusing the particles to obtain a protective overcoat over the entire surface of the image layer.

In U.S. Pat. No. 5,321,467, issued Jun. 14, 1994, to Tanaka et al., there is disclosed an image forming apparatus comprised of a plurality of different image forming units for recording with different methods. An ink jet recording unit is arranged on the upstream side of an electrophotography recording unit in a transporting path of a recording medium. Recording of the ink jet recording unit is performed prior to that of the electrophotography recording unit.

In U.S. Pat. No. 5,729,785, issued Mar. 17, 1998, to Sakaizawa et al., there is disclosed an image forming apparatus for forming an image on a recording medium including a first conveying path for conveying a recording medium in order to form an image thereon using a first image forming device, a second conveying path for conveying a recording medium in order to form an image thereon using a second image forming device for forming an image according to an image forming method different from an image forming method of the first image forming device, a third conveying path for conveying a recording medium in order to form an image thereon using the first image forming device and the second image forming device, and a setting device for selectively setting one of a first conveying mode using the first conveying path, a second conveying mode using the second conveying path, and a third conveying mode using the third conveying path.

In U.S. Pat. No. 5,612,777, issued Mar. 18, 1997, to Malhotra, there is disclosed an apparatus and method for creating color images which are coated with a composition including a lightfastness inducing material and a hydrophobic polymeric binder which protects the images from rough handling and degradation from exposure to UV radiation in the light.

In U.S. Pat. No. 4,997,697, issued Mar. 5, 1991, to Malhotra, there is disclosed a transparent substrate material for receiving or containing an image which comprises a supporting substrate base, an antistatic polymer layer coated on one or both sides of the substrate and comprising hydrophilic cellulosic components, and a toner receiving polymer layer contained on one or both sides of the antistatic layer, which polymer comprises hydrophobic cellulose ethers, hydrophobic cellulose esters, or mixtures thereof, and wherein the toner receiving layer contains adhesive components.

The following U.S. patents are of interest and disclose, for example, aqueous ink jet ink formulations and imaging processes thereof, that are potentially useful adjuncts to the present invention: U.S. Pat. Nos. 5,180,425; 5,658,376; 5,772,746; 5,630,868; 5,749,950; 4,680,235; 5,672,198; 5,397,807; 5,698,016; 4,994,520; 5,725,647; 5,725,650; and 5,026,427. The aforementioned patents are incorporated by reference herein in their entirety.

The hybrid colorless toner-ink printing apparatus and printing processes of the present invention are useful in many applications including imaging and printing processes, including high quality-low cost per impression multicolor nonimpact printing, for example, thermal ink jet (TIJ), bubble jet, ballistic marking, and acoustic ink printing systems, including digital systems.

Typical dye-based and certain pigment based ink jet inks suffer from deficiencies, for example, in water fastness, smear resistance, light fastness, gloss, and appearance properties, after being printed on various substrates. Pigment based inks can provide an image, on a wide variety of substrates, having high optical density with high water fastness, smear resistance and light fastness, and therefore pigment based are generally preferred to dye based formulations. Nevertheless, the dye and or pigment based ink images are susceptible to print quality defects arising from and inherent in the jetting process, and to variability and idiosyncrasies associated with the receiver substrate media, such as, highly porous media leading to image defects from non-uniform absorption and non porous media leading to smearing. The images typically remain highly vulnerable to environmental image deterioration.

Thus there remains a need for improved image quality and image stability in ink jet type printing devices and processes. These and other improvements are accomplished in embodiments of the present invention and as illustrated herein.

SUMMARY OF THE INVENTION

Embodiments of the present invention, include:

A process comprising:

depositing a colorless toner composition onto a charged substrate;

depositing at least one ink image onto the colorless toner and substrate; and fusing the resulting ink image onto the substrate; and An image forming apparatus comprising:

a charging device for charging the non-image side of a substrate;

a non-imaging developer housing for depositing charged colorless toner onto the image side of the substrate during charging of the substrate;

an ink image forming device for depositing colored ink images onto the colorless toner residing on the substrate; and a fuser member for fusing the combined deposited ink image and colorless toner to the substrate.

DETAILED DESCRIPTION OF THE INVENTION

The present invention is directed to creating high lightfast color images which exhibit a improved image quality and durability, for example a high degree of smear and abrasion resistance. Such images, as will be disclosed herein, can be created by forming ink images on a receiver substrate which has deposited thereon an unfused layer of colorless toner particles, and thereafter fixing the combined ink image and colorless toner to the receiver substrate.

The present invention provides, in embodiments, an image recording process comprising:

depositing a colorless toner composition onto a substrate;

depositing at least one ink image onto the colorless toner and receiver; and fusing the resulting ink image onto the substrate.

According to the present invention, the non-image side of the substrate, also referred to as the receiver substrate, can be substantially completely charged by, for example, a corona discharge while depositing colorless toner particles onto the opposite or image receiving side of the receiver substrate. In embodiments, the colorless toner preferably has a charge polarity opposite the charge polarity being applied to the non-image side of the receiver substrate thereby facilitating the deposition and adhesion of the unfused colorless toner to the charging receiver substrate and during the deposition of the ink image thereon. The deposited colorless toner particles and the subsequent combination of ink image and colorless toner particles preferably adhere to the receiver substrate by van der Waals forces prior to fusing.

In embodiments of the present, the colorless toner can be deposited substantially completely and uniformly on the receiver substrate. That is, the colorless toner can be deposited onto the receiver substrate to afford substantially complete and uniform coverage of the receiver substrate with colorless toner. Alternatively, the colorless toner particles can be selectively deposited onto the receiver substrate to afford a receiver substrate which is incompletely covered with colorless toner particles, that is, depositing colorless toner onto the receiver substrate selectively to areas in slight area excess of intended ink area deposition, for example, to account for respective registration errors, thereby expanding the registration latitude of toner and ink deposition steps, and thereby affording only partial coverage of the receiver substrate with colorless toner. In embodiments, the colorless toner is preferably deposited on the image side of the receiver substrate simultaneously with the charge deposition on the non-image side of the receiver substrate. In embodiments, typical colorless toner deposition levels, that is toner mass per unit area (TMA), can be from about 0.1 $mg/cm^2$ to about 10 $mg/cm^2$ and preferably from about 0.4 $mg/cm^2$ to about 2.0 $mg/cm^2$, and more preferably from about 0.4 $mg/cm^2$ to about 1.0 $mg/cm^2$.

The ink deposition and imaging processes of the present invention can include a single ink image formed in a single pass, or alternatively, there can be formed a plurality of ink images on the receiver substrate, for example, from about 2 to about 1,000 ink images, and preferably from about 2 to about 100 images, in one or more passes through the ink image deposit forming station. In a preferred embodiment, the ink deposition and ink image formation is accomplished by jetting using known ink jet jetting devices.

The ink selected to form the ink images contains a colorant such as known pigments, dyes, and mixtures thereof. The receiver substrate can be selected, for example, paper, transparency materials, plastics, polymeric films, treated cellulosics, wood, and mixtures thereof, and optional additives coated thereon. The optional additives can include, for example, light fastness improving compounds, stability enhancing compounds, such as ultraviolet light absorbing compounds and antioxidants, anti-curl compounds, such as trimethylolpropane for cool curl control, hydrophilic compounds, polyethylene oxide and propylene oxide polymers, surfactants such as low HLB (0–6) compounds, including non-ionic, anionic, cationic, and zwitterionic compounds, ink gellation agents such as gum additives including xanthan gum, agar, guar, lecithin, and the like materials, and mixtures thereof, and which additives can function to render the colorless toner treated receiver sheet more receptive to the deposit and retention of aqueous based ink formulations. The colorless toner can be comprises substantially of colorless resin particles. The colorless resin particles can be formulated using conventional and known materials, and as illustrated herein. The ink jet image formed on the colorless toner treated receiver substrate exhibits substantially reduced or eliminated image defects such as edge acuity and intercolor bleed repression, stitch mottle, and the like defects, and as illustrated herein.

The fusing of the combined ink image and the colorless toner to the receiver substrate can be accomplished with known and conventional fusing methodologies including, for example, heat, light, pressure, and combinations thereof.

The present invention also provides an image forming apparatus comprising:

a charging device for charging the non-image side of a receiver substrate;

a non-imaging developer housing for depositing charged colorless toner onto the image side of the charged receiver substrate;

an ink image forming device for depositing one or more colored ink images onto the colorless toner residing on the receiver substrate; and a fuser member for fusing the deposited ink image residing on the colorless toner to the receiver substrate.

The imaging apparatus, in embodiments, can include a conveyor and conveying path for conveying the receiver substrate to the charging and colorless toner depositing device area, thereafter to the ink image forming apparatus area, and thereafter to the fuser area.

The ink image forming device is preferably by an ink-jet image formation device accomplished by discharging ink or inks from at least one nozzle. The ink jetting assembly can comprise, for example, an ink reservoir in communication with one or more jet nozzles.

The present invention also provides a printing apparatus comprising:

a charger or charging device which is adapted to charge the non-image side of an image receiver substrate;

a developer housing which is adapted to deposit colorless toner onto the receiver substrate, wherein the toner is deposited on the opposite side of the receiver substrate which is simultaneously being charged by the charger, and wherein the colorless toner is of opposite polarity or sign to the polarity or sign of the charge being applied to the non-image side of the receiver substrate;

an ink jetting assembly which is adapted to, preferably controllably, deliver ink to the colorless toner layer on the receiver substrate;

a fixing device which is adapted to cause the ink image and the colorless toner to be substantially permanently attached to the receiver substrate; and a conveyor which is adapted to sequentially convey the image receiver substrate between the charger and developer station, the ink jetting assembly, and finally the fixing device. Alternatively, the conveyor can be configured to sequentially move the charger and developer station, the ink jetting assembly, and the fixing device into close proximity to a receiver substrate station or locus.

The colorless toner-developer can include, for example, (1) a binder in the form of a clear resin toner such as:(A) polyesters; (B) polyvinyl acetals; (C) vinyl alcohol-vinyl acetal copolymers; (D) polycarbonates; (E) styrene—alkyl acrylate copolymers and styrene—aryl alkyl acrylate copolymers; (F) styrene-diene copolymers; (G) styrene—maleic anhydride copolymers; (H) styrene—allyl alcohol copolymers; and mixtures thereof; (2) optional charge control additives such as alkyl pyridinium halides, cetyl pyridinium chloride, cetyl pyridinium tetrafluoroborates, quaternary ammonium sulfate and sulfonate compounds, such as distearyl dimethyl ammonium methyl sulfate; (3) optional surface additives such as straight silica, colloidal silica, UNILIN™, polyethylene waxes, polypropylene waxes, aluminum oxide, stearic acid, polyvinylidene fluoride, and the like; (4) optional surfactants such as nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and the like; and (5) a lightfastness inducing agent such as 1,2-hydroxy-4-(octyloxy)benzophenone, 2-(4-benzoyl-3-hydroxyphenoxy) ethylacrylate and the like. Preferably, the binder comprises a polycarbonate in order to provide the toner image with a finish that exhibits excellent abrasion resistance.

Any suitable substrate can be employed. Illustrative examples of commercially available internally and externally surface sized papers include Diazo papers, offset papers, such as Great Lakes offset, recycled papers, such as Conservatree, office papers, such as Automimeo, Eddy liquid toner paper and copy papers available from companies such as Nekoosa, Champion, Wiggins Teape, Kymmene, Modo, Domtar, Veitsiluoto, Sanyo, and coated base papers available from companies such as Scholler Technical Papers, Inc. and the like. Examples of substantially transparent substrate materials include polyesters, including MYLAR™, available from E. I. Du Pont de Nemours & Company, MELINEX™, available from Imperial Chemicals, Inc., CELANAR™, available from Celanese Corporation, polyethylene naphthalates, such as Kaladex PEN Films, available from Imperial Chemicals, Inc., polycarbonates such as LEXAN™, available from General Electric Company, polysulfones, such as those available from Union Carbide Corporation, polyether sulfones, such as those prepared from 4,4'-diphenyl ether, such as UDEL™, available from Union Carbide Corporation, those prepared from disulfonyl chloride, such as Victrex™, available from ICI Americas Incorporated, those prepared from biphenylene, such as ASTREL™, available from 3M Company, poly(arylene sulfones), such as those prepared from crosslinked poly(arylene ether ketone sulfones), cellulose triacetate, polyvinylchloride cellophane, polyvinyl fluoride, polyimides, and the like, with polyester such as MYLAR™ being preferred in view of its availability and relatively low cost. The substrate can also be opaque, including opaque plastics, such as TESLIN™, available from PPG Industries, and filled polymers, such as MELINEX™, available from ICI. Filled plastics can also be employed as the substrate, particularly when it is desired to make a "never-tear paper" recording sheet.

Stitch mottle is a printing defect associated with ink jet and related printing processes and which defect is readily observable in solid area printing and consists of nonuniformity in swaths or passes which cause or create visible lines of lighter areas or inkless gaps. While printing a solid area with thermal ink jet inks onto papers, the stitch mottle phenomena occurs along the stitch or boundary lines between print swaths. The ink coverage is not uniformly distributed and the ink can diffuse unevenly across the stitch, creating the so-called "stitch line" between swaths as visibly lighter or inkless areas. This stitch mottle phenomenon is different from other printing defects such as leading edge defect where only the beginning of the printing areas is non-uniform or appears streaky but dissipates with continued printing. Stitch mottle appears generally, at least to some extent, across the entire length of the stitch lines, that is between swaths, and generally does not disappear or dissipate with prolonged printing. The extent of stitch mottle defect can be assessed in a number of ways, for example, judged by visual observation and graded by a trained observer, such as on a calibrated scale of from 1 to 5; with 1 being the worst image quality attributable to stitch mottle, 3 being intermediate stitch mottle, and 5 being the best image quality and exhibiting essentially no stitch mottle defect. The present invention can greatly reduce or eliminate the incidence of stitch mottle defects.

The receiver sheet treatment, that is the deposition of colorless toner is preferably accomplished before the receiver substrate receives ink jet ink, and preferably deposition of colorless toner occurs simultaneously with the charging of the non-image side of the receiver substrate. Alternatively, in embodiments, the receiver sheet treatment can be accomplished at the same time or concurrently with the receiver while receiving ink jet ink. In a preferred embodiment, the receiver sheet treatment can be made to an area including the ink image area. Alternatively, the receiver sheet colorless toner treatment can be to an area adjacent to an ink image area, for example, in areas immediately adjacent to the ink jet swath.

The receiver sheet or substrate can be, for example, known ink jet receiver materials, such as paper, transparency materials, plastics, polymeric films, treated cellulosics, wood, and the like materials, and preferably where the ink jet image formed on the substrate dries in less than about 15 seconds, such as from about 1 to about 15 seconds.

The ink formulation can include other optional performance additives such as surfactants, for example, an alkylaryl polyether alcohol and derivatives. The surfactant can be present in an amount of, for example, from about 0.01 to about 5 weight percent, preferably from about 0.01 to about 2.5 percent, and more preferably from about 0.01 to about 1.5 percent by weight of the total ink mixture.

Ink formulations used in the present invention can further include known performance or value enhancing additives such as biocides, humectants, chelating agents, viscosity modifiers, and the like, and mixtures thereof. Other optional additives include adjuvants such as butyl carbitol type solvents, and ionic surfactants such as sodium lauryl sulfate.

The colored ink compositions of the present invention can comprise conventional ingredients including, for example, an aqueous liquid vehicle, a colorant, and optional performance additives.

The colorant particles can have a particle size distribution where at least about 75 percent, for example, from about 70 to about 90, of the particles have a diameter below about 0.15 microns, that is, for example from about 0.01 to about 0.14 microns in volume average diameter with the remaining particles in the dispersion having a diameter less than or equal to about 0.5 microns, such as from about 0.5 to about 1 micron. More specifically the inks of the present invention are comprised of a major amount of water, at least one colorant, such as pigment particles, especially carbon black, alkylene glycols, such as ethylene glycol, and other known ink additives such as biocides, sulfolane, and the like. Also, the present invention relates to high resolution printing processes comprising applying the inks in imagewise fashion to a substrate wherein stitch mottle print defects are substantially reduced or eliminated.

The inks can possess a latency of at least 20 seconds, for example, from about 20 to about 40 seconds, in a printer having at least one nozzle of a channel width or diameter ranging from about 10 to about 40 microns, and wherein the ink remains stable for extended time periods, up to a year of closed storage at ambient conditions with no settling or jelling.

The colorant particles can be pigments such as carbon black, magnetites, and colored pigments for color printing applications as identified herein, and mixtures thereof, and can be selected in an amount of from about 1 to about 20 weight percent, and preferably in an amount of from about 2 to about 7 weight percent of the total ink mixture. The colorant can also be, or in addition to a pigment, include one or more dye compounds which are at least weakly or substantially soluble in the final ink formulation, and can be present in amounts of from about 0.1 to about 15 weight percent and preferably from about 0.1 to about 10 percent by weight based on the total ink mixture. When the colorant is a pigment, there is selected preferred pigment particle sizes in the final ink formulation of from about 0.05 to about 10 microns, and preferably from about 0.05 to about 5 microns, and more preferably from about 0.05 to about 4 microns. When a carbon black dispersion is selected as the colorant, a preferred particle size distribution is: with at least about 90 percent by weight of the particles with a diameter of about 0.05 to about 0.2 microns and the balance of particles with a diameter of about 0.2 to about 2.0 microns.

The colorant for the ink compositions of the present invention is preferably a pigment, although it is readily understood by one of ordinary skill in the art that non pigment compounds can be used in place of a pigment or in addition to a pigment or pigments. The pigment is preferably carbon black, examples of other pigments include cyan, magenta, yellow, red, blue, green, brown, mixtures thereof, and the like. Preferred carbon black pigments for use in the present invention include LEVANYL® and CABOJET® 300 carbon black from Cabot Corporation, and FLAME BLACK® carbon black from Prolabo Corporation. Examples of suitable black pigments include other known carbon blacks such as channel black, furnace black, lamp black, and the like. Colored pigments include red, green, blue, brown, magenta, cyan, and yellow particles, and mixtures thereof. Illustrative examples of magenta pigments include 2,9-dimethyl-substituted quinacridone and anthraquinone, identified in the Color Index as CI 60710, CI Solvent Red 19, and the like. Illustrative examples of suitable cyan pigments include copper tetra-4-(octadecyl sulfonamido) phthalocyanine, X-copper phthalocyanine pigment, listed in the color index as CI 74160, CI Pigment Blue, and Anthrathrene Blue, identified in the Color Index as CI 69810, Special Blue X-2137, and the like. Illustrative examples of yellow pigments that can be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy aceto-acetanilide, Permanent Yellow FGL, and the like. Preferred pigment dispersions include carbon blacks, such as Hostafine Black (T and TS), Sunsperse 9303, and more preferably LEVANYL BLACK A-SF and CABOJET® 300.

Preferably, the pigment particle size is of a size to enable a stable colloidal suspension of the particles in the liquid vehicle and to prevent clogging of the ink jet nozzle channels when the ink is used in a thermal ink jet printer. Preferred average particle diameters are generally from about 0.001 to about 5 microns, and more preferably from about 0.01 to about 3 microns, although the particle size can be outside these ranges. A more preferred pigment particle size range includes particles having at least 70% of the particles being below about 0.1 micron with no particles being greater than 1.0 micron, as measured with a Hosakawa CAPA 700 Particle Size Analyzer. An even more preferred pigment particle size range includes particles having at least 90% of the particles below about 0.1 micron with no particles being greater than 1.0 micron.

The pigment can be present in the ink composition in various effective amounts, for example from about 1 to about 20 percent by weight, preferably from about 3 to about 7 percent by weight, more preferably from about 4 to about 6 percent by weight and most preferably from about 5 to about 6 percent, although the amount can be outside of these ranges.

Polymeric performance additives can also be added to the inks to enhance the viscosity of the ink, including water soluble polymers such as Gum Arabic, polyacrylate salts, polymethacrylate salts, polyvinyl alcohols, hydroxy propylcellulose, hydroxyethylcellulose, polyvinylpyrrolidinone, polyvinylether, starch, polysaccharides, polyethyleneimines modified with polyethylene oxide and polypropylene oxide, such as the DISCOLE® series available from DKS International, Tokyo, Japan, the JEFFAMINE® series available from Texaco, Bellaire, Tex., and the like additives. Polymeric additives may be present in the ink in amounts of from 0 to about 10 percent by weight, preferably from about 0.001 to about 8 percent by weight, and more preferably from about 0.01 to about 5 percent by weight, although the amount can be outside these ranges.

Further optional additives to the inks include biocides, such as DOWICIL 150, 200, and 75, benzoate salts, sorbate salts, and the like, present in an amount of from 0 to about 10 percent by weight, preferably from about 0.001 to about 8 percent by weight, and more preferably from about 0.01 to about 4.0 percent by weight, although the amount can be outside these ranges, penetration control additives such as N-methylpyrrolidinone, sulfoxides, ketones, lactones, esters, alcohols, butyl carbitol, benzyl alcohol, cyclohexylpyrrolidinone, 1,2-hexanediol, and the like, present in an amount of from 0 to about 50 percent by weight, and preferably from about 5 to about 40 percent by weight, although the amount can be outside these ranges, pH controlling agents such as acids or bases, phosphate salts, carboxylates salts, sulfite salts, amine salts, and the like, present in an amount of from 0 to about 1 percent by weight, preferably from about 0.001 to about 1 percent by weight, and more preferably from about 0.01 to about 1 percent by weight, although the amount can be outside these ranges.

Other examples of suitable ink additives include those illustrated in U.S. Pat. Nos. 5,223,026 and 5,207,825, the disclosure of each patent is totally incorporated herein by reference.

The inks of the present invention can be prepared by any suitable conventional process and variants thereof.

Aqueous ink compositions according to the present invention may also be provided by mixing the formed inks with humectants, and other ink additives. The mixing can be done by various methods including homogenizing, sonification, microfluidization, mechanical mixing, magnetic stirring, high speed jetting, and the like. The sonification process is preferred since such process provides a homogeneous dispersion by evenly distributing the dispersant throughout the pigment dispersion. The stabilized dispersed pigment can be used as an ink as is, but preferably the thoroughly mixed pigment ink mixture is first centrifuged by a batch process or a continuous process utilizing commercially available equipment, such as bottle centrifuges, preparative ultracentrifuges, analytical ultracentrifuges, zonal centrifuges, tubular centrifuges, disk centrifuges, continuous conveyor-discharge centrifuges, basket centrifuges, liquid cyclones, and the like to remove large pigment particles from the ink. Centrifuging is preferably conducted for a time sufficient to remove large size particles and at a rate of about 4,000 to 8,000 rpm. The continuous centrifuge process is very useful in the commercial production of large quantities of pigment ink for the separation of large pigment particles from the ink. The ink is also preferably subjected to a filtration process which utilizes various commercial filtration media including cartridges constructed from nylon, polyester, TEFLON®, polysulfone, and other suitable polymeric materials; membranes; porous ceramic media; cloth; and the like. The filter is of a size that removes particles greater than about 3 microns, preferably greater than 1.2 micron, and more preferably greater than about 1 micron. Any suitable filtration method, such as continuous and/or batch filtration methods, may be used. Continuous filtration methods are preferred for large scale production of pigment inks. Inks which have been centrifuged and filtered so as to preferably remove particles greater than 1 micron in size from the ink are suitable for use as ink jet inks because of their ability to not clog the ink jet and their long latency and jetting stability.

Inks of the present invention can be formulated in an aqueous liquid vehicle such as deionized water and homogenous mixtures of water and suitable miscible organic solvents, and the aqueous liquid vehicle can be present in an amount of from about 75 to about 99 weight percent of the total ink composition.

The liquid vehicle of the inks include a major amount of water, for example from about 50 to about 90, and preferably from about 75 to about 80 weight percent, and may comprise a mixture of water and a miscible organic component, such as glycols, for example, ethylene glycol, propylene glycol, diethylene glycols, glycerine, dipropylene glycols, polyethylene glycols, polypropylene glycols; amides; ethers; carboxylic acids; esters; alcohols; organosulfides; organosulfoxides; sulfones; dimethylsulfoxide; sulfolane; alcohol derived compounds, such as carbitol, butyl carbitol, CELLUSOLVE, and ethers thereof; amino alcohols; ketones; and other water miscible materials, and mixtures thereof. The present invention also contemplates in embodiments the use of non-aqueous based inks comprised of either or both pigments and dyes.

The inks of the present invention can optionally contain one or more known performance additives such as biocides, humectants, chelating agents, viscosity modifiers, and mixtures thereof, including glycols in an amount of from about 10 to about 20 weight percent, and more preferably from about 12 to about 16 weight percent, sulfolanes, in an amount of from about 2 to about 6 weight percent, and more preferably about 2 to about 4 weight percent, biocides in the amount of about 0.01 to about 0.1 weight percent, and surfactants, for example DOWICIL 200, in the amount of about 0.01 to about 0.1 weight percent. The humectant can be, for example, ethylene glycol, propylene glycol, diethylene glycols, glycerine, dipropylene glycols, polyethylene glycols, polypropylene glycols, amides, ethers, carboxylic acids, esters, alcohols, organosulfides, organosulfoxides, sulfones, alcohol derivatives, carbitol, butyl carbitol, CELLUSOLVE, ether derivatives, amino alcohols, ketones, and mixtures thereof, and can be present in an amount of from about 3 to about 60 percent by weight of the total weight of the ink composition.

When mixtures of water and water miscible organic liquids are selected as the liquid vehicle, the water to organic ratio may be any effective range, and typically is from about 100:0 to about 30:70, preferably from about 97:3 to about 50:50, although the ratio can be outside these ranges. The non-water component of the liquid vehicle generally serves as a humectant which can have a boiling point higher than water (100° C.). The pigment dispersion can be mixed with different humectants or solvents in ink jet inks including ethylene glycol, diethylene glycol, propylene glycol, dipropylene glycol, polyethylene glycols, polypropylene glycols, glycerine, trimethylolpropane, 1,5 pentanediols, 1,6-hexanediols, diols and triols containing from about 2 to about 10 carbons, sulfoxides, for example dimethylsulfoxide, alkylphenyl sulfoxides, and the like, sulfones such as sulfolane, dialkyl sulfones, alkyl phenyl sulfones, and the like, amides, for example N,N-dialkyl amides, N,N-alkyl phenyl amides, N-methylpyrrolidinone, N-cyclohexylpyrrolidinone, N,N-diethyltoluamide, and the like, ethers such as alkyl ether derivatives of alcohol, ether diols, and ether triols including butylcarbitol, alkyl polyethyleneglycols, and the like, urea, betaine, the thio (sulfur) derivatives of the aforementioned compounds, for example thioethylene glycol, trithioethylene glycol, and the like. Desired penetrants, water soluble polymers, pH buffer, biocides, chelating agents, such as EDTA and the like, and other optional additives can also be used.

Another important measured property for an ink jet ink is the latency or decap time, which is the length of time over which an ink remains fluid in a print head opening or nozzle when exposed to air and, therefore, capable of firing a drop of ink at its intended target. Latency is the maximum idling times allowed for ink to be jetted by a printer with a speed equal to or greater than about 5 meters per second which is equivalent to an ink traveling a distance of 0.5 mm in less than 100 microseconds without a failure. The latency test is accomplished with the print head or nozzles uncovered or decapped and generally at a relative humidity of about 15 percent. The latency time interval is the longest length of time that the print head, uncovered, will still fire a specified drop without drop displacement or loss of density. The longer the latency time rating, the more reliable and desirable the ink. Many of the inks of the present invention possess of these characteristics. Generally, the inks possess excellent latency of at least about 10 seconds, more generally on the order of about 40 seconds to greater than about 1,000 seconds, with a minimum latency of at least 10 seconds being preferred. The inks of the present invention can have a jetting latency of from about 1 to about 20 seconds, and preferably from about 25 to about 100 seconds.

The viscosity of the inks can be from of about 1.0 cP to about 5.0 cP, and exhibit a drying time of no more than about 15 seconds when jetted onto plain paper in an ink jet printing process at ambient conditions. The viscosity of the ink composition is preferably less than about 3.0 cps (cP), more preferably less than about 2.5 cps, and even more preferably about 2 to about 2.8 cps.

The present invention provides imaging processes comprising the development of an image with the ink compositions as disclosed and illustrated herein in an ink jet printing machine. An exemplary imaging process comprises applying in imagewise fashion to a receiver substrate that have been pretreated with colorless toner in an ink jet printer having at least one nozzle of a channel width or diameter ranging from about 1.0 to about 4 microns and wherein high resolution images result, for example, a preferred ink jet printing apparatus employs a thermal ink jet printing process and droplets of ink are caused to be ejected by selectively heating the ink and wherein there are provided moderate to high resolution, for example, 300, and more preferably 600 spots per inch (spi), and wherein the ejection is preferably accomplished on-demand. Thus, there are provided processes for generating images on a substrate comprising incorporating one or more ink compositions into an ink jet printing apparatus and causing droplets of the ink composition to be ejected in an imagewise pattern onto the receiver substrate supporting a layer of adherent colorless toner, the substrate being, for example, paper, transparency materials, plastics, polymeric films, wood, and combinations thereof, wherein the image formed on the substrate dries in less than about 15 seconds.

The inks can be selected for use in ink jet printing processes, and especially thermal ink jet processes and wherein image smearing is minimized, or avoided entirely. Moreover, images developed with the inks on the colorless toner under layer of the present invention enable ink jet prints with excellent resolution, acceptable density, excellent waterfastness, minimum or very low show through, excellent MFLEN, and little or no stitch mottle image defects.

Ink jet printing can be considered a non-impact printing method that produces droplets of ink that are deposited on a substrate such as paper or transparent film in response to an electronic digital signal. Thermal or bubble jet drop-on-demand ink jet printers have found broad application as output devices for, for example, personal computers in the office and the home.

In existing thermal ink jet printing devices, the print head typically consists of one or more ink jet ejectors, such as disclosed in U.S. Pat. No. 4,463,359, the disclosure of which is totally incorporated herein by reference, each ejector including a channel communicating with an ink supply chamber, or manifold, at one end and having an opening at the opposite end, referred to as a nozzle. A thermal energy generator, usually a resistor, is located in each of the channels, at predetermined distance from the nozzles. The resistors are individually addressed with a current pulse to momentarily vaporize the ink and form a vapor bubble which in turn displaces or expels an ink droplet. As the bubble grows, the ink rapidly bulges from the nozzle and is momentarily contained by the surface tension of the ink as a meniscus. This is a very transient phenomenon, and the ink is quickly propelled toward a receiving print sheet. As the bubble begins to collapse, the ink still in the channel between the nozzle and bubble starts to move toward the collapsing bubble, causing a volumetric contraction of the ink at the nozzle and resulting in the separation from the nozzle of the bulging ink as a droplet. The feed of additional ink can provide the momentum and velocity for propelling the droplet toward a receiving print sheet, such as a piece of paper. Since the droplet of ink is emitted only when the resistor is actuated, this type of thermal ink-jet printing is known as "drop-on-demand" printing. Other types of ink-jet related printing devices includes continuous-stream, acoustic, and ballistic methods.

In a single-color ink jet printing apparatus, the print head typically comprises a linear array of ejectors, and the print head is moved relative to the surface of the print sheet, either by moving the print sheet relative to a stationary print head, or vice-versa, or both. In some types of apparatus, a relatively small print head moves across a print sheet numerous times in swathes, much like a typewriter. Alternatively, a print head which consists of an array of ejectors and extends the full width of the print sheet may be passed once down the print sheet to give full-page images, in what is known as a "full-width array" (FWA) printer. When the print head and the print sheet are moved relative to each other, imagewise digital data is used to selectively activate the thermal energy generators in the print head over time so that the desired image will be created on the print sheet.

In view of the demand for higher resolution printers, the nozzles in ink jet printers are continuing to decrease in size. Nozzle openings are typically about 50 to 80 micrometers in width or diameter, for example as found in a 300 spots per inch (spi) printer. With the advent of 600 spi printers, these nozzle openings are typically about 10 to about 40 micrometers in width or diameter. These small dimensions require inks which do not plug the openings.

In imaging processes the ink may be applied to a suitable substrate in an imagewise fashion. Application of the ink to the substrate can be by any suitable process compatible with aqueous-based inks, such as flexographic printing, pen plotters, continuous stream ink jet printing, drop-on-demand ink jet printing including both piezoelectric and thermal ink jet processes, and the like printing devices. The substrate employed can be any substrate compatible with aqueous-based inks, including plain paper, such as Xerox® series 10 paper, Xerox® 4024 paper, and the like, coated papers, such as those available from Jujo, transparency materials suitable for aqueous inks or ink jet printing processes, and the like receivers.

The invention will further be illustrated in the following nonlimiting Examples, it being understood that these Examples are intended to be illustrative only and that the invention is not intended to be limited to the materials, conditions, process parameters, and the like, recited herein. Parts and percentages are by weight unless otherwise indicated.

Comparative Example I

Ink Jet Iimaging on Untreated Reciever Substrate—No Pretreatment with Colorless Toner Ink jet prints were prepared with a Hewlett-Packard Model 694C with standard 694C CyanYellowMagenta (CYM) dye based inks and black (K) pigment based ink on Courtland 4024DP, Xerox 4024, and Xerox Color Xpressions paper as the receiver substrates.

Example I

Ink Jet Imaging on Receiver Substrate Pretreated with Colorless Toner

Comparative Example I was repeated with the exception that the receiver sheet paper was pretreated, for example, by corona charging, and simultaneous substantially complete deposition of colorless toner thereon prior to jetting the ink image onto the receiver sheet. Upon fusing the resulting combined colorless toner and ink image to the receiver there resulted: a substantial reduction or elimination of image smear in the resulting print; there was a decrease of the mid frequency line edge noise (MFLEN); and there was notable waterfastness improvement. Colorless toner deposition levels were from about 0.4 mg/cm$^2$ to about 1 mg/cm$^2$.

Table 1 summarizes exemplary improvements in the MFLEN on Xerox 4024 paper. Improvements in wet smear and waterfastness on Xerox Color Xpressions is summarized in Table 2.

Other modifications of the present invention may occur to one of ordinary skill in the art based upon a review of the present application and these modifications, including equivalents thereof, are intended to be included within the scope of the present invention.

TABLE 1

Colorless Toner Pretreatment Image Quality Enhancement

| LINE COLOR | TONER COATING | MFLEN |
|---|---|---|
| Cyan | Yes | 16 |
| Magenta | Yes | 17 |
| Green | Yes | 20 |
| Red | Yes | 19 |
| Pigment Black | Yes | 1 |
| Pigment Black Over Yellow | Yes | 15 |
| Cyan | No | 23 |
| Magenta | No | 19 |
| Green | No | 25 |
| Red | No | 26 |
| Pigment Black | No | 5 |
| Pigment Black Over Yellow | No | 20 |

TABLE 2

Colorless Toner Pretreatment Image Stability Enhancement

| IMAGE COLOR | SMEAR DENSITY | WATERFASTNESS |
|---|---|---|
| Cyan | 0.05 | 47% |
| Magenta | 0.06 | 52% |
| Black | 0.18 | 94% |
| Coated Cyan | 0 | 100% |
| Coated Magenta | 0 | 100% |
| Coated Black | 0 | 100% |

What is claimed is:

1. A process comprising:

depositing a colorless toner onto a first side of a substrate;

depositing at least one ink jet image onto the colorless toner on the first side or image side of the substrate to form an image on the first side of the substrate; and fixing the resulting ink image and a colorless toner onto the first side or image side of the substrate, wherein the second side or non-image side of the substrate is substantially completely charged by a corona discharge while depositing the colorless toner on the first side or image side of the substrate, and where the resulting fixed ink jet image formed exhibits substantially reduced or eliminated image defects of edge acuity and intercolor bleed repression.

2. A process in accordance with claim 1, wherein the colorless toner has a charge polarity opposite the charge polarity being applied to the second side or non-image side of the substrate.

3. A process in accordance with claim 1, wherein the colorless toner and the combination of ink image and colorless toner adhere to the substrate prior to fusing.

4. A process in accordance with claim 1, wherein the colorless toner is deposited completely and uniformly on the substrate.

5. A process in accordance with claim 1, wherein the colorless toner is selectively and partially deposited on the substrate.

6. A process in accordance with claim 1, wherein said at least one ink image comprises from about 2 to about 100 ink images.

7. A process in accordance with claim 1, wherein an ink is used to form the ink image and the ink is comprised of at least one colorant selected from the group consisting of pigments, dyes, and mixtures thereof.

8. A process in accordance with claim 1, wherein the substrate is selected from the group consisting of paper, transparency materials, plastics, polymeric films, treated cellulosics, wood, and mixtures thereof, and optional additives thereon; and wherein the colorless toner comprises substantially colorless resin particles.

9. A process in accordance with claim 8, wherein the optional additives include lightfastness improving compounds, stability enhancing compounds, anti-curl compounds, hydrophilic compounds, ink gellation agents, and mixtures thereof.

10. A process in accordance with claim 1, wherein the fixing is accomplished with heat, light, pressure, or combinations thereof.

11. A process in accordance with claim 1, wherein the colorless toner is deposited on the first or image side of the substrate simultaneously with the charge deposition on the second or non-image side of the substrate.

* * * * *